US005526918A

United States Patent [19]

Dullighan et al.

[11] Patent Number: 5,526,918

[45] Date of Patent: Jun. 18, 1996

[54] COIN VALIDATING APPARATUS AND METHOD

[75] Inventors: John Dullighan, Yardley, Pa.; Ilia Kirshner, Glendale, N.Y.; Gerald Smith, Clayton, N.J.; John Wick, Parkesburg, Pa.

[73] Assignee: Greenwald Industries Inc., Brooklyn, N.Y.

[21] Appl. No.: 490,769

[22] Filed: Jun. 15, 1995

[51] Int. Cl.[6] ..... G07D 5/08

[52] U.S. Cl. ..... 194/317; 194/346

[58] Field of Search ..... 194/202, 203, 194/317, 318, 319, 328, 330, 334, 335, 346

[56] References Cited

U.S. PATENT DOCUMENTS

| | | | |
|---|---|---|---|
| 3,796,295 | 3/1974 | Montolivo et al. | 194/319 |
| 3,870,137 | 3/1975 | Fougere | 194/317 |
| 3,918,563 | 11/1975 | Schwippert et al. | 194/318 |
| 3,918,565 | 11/1975 | Fougere et al. | 194/317 |
| 4,086,527 | 4/1978 | Cadot | 194/318 X |
| 4,416,364 | 11/1983 | Bellis et al. | 194/319 |
| 5,191,957 | 3/1993 | Hayes | 194/318 |
| 5,392,891 | 2/1995 | Ferguson et al. | 194/317 |
| 5,429,222 | 7/1995 | Delay | 194/346 X |

*Primary Examiner*—Frank E. Werner
*Assistant Examiner*—Scott L. Lowe
*Attorney, Agent, or Firm*—McAulay Fisher Nissen Goldbert & Kiel

[57] ABSTRACT

A coin validating system typically used in a coin operated machine electrically couples a stationary coin to the tuning coils of an oscillator circuit. While the coin is in a stationary position and the oscillator is tuned to a first rest frequency, the output frequency and output amplitude of the oscillator is measured. The metal coin will increase the signal frequency from its rest frequency and will decrease the signal amplitude from its rest amplitude. While the coin is stationary, frequency and amplitude are measured and compared with expected parameters of a valid coin. If a match is made, the rest frequency of the oscillator circuit is changed. At the second test frequency, signal frequency and amplitude are measured and compared with expected frequency and amplitude parameters for a valid coin. Only if a match is made at both the high frequency and the low frequency is an accept gate actuated.

19 Claims, 4 Drawing Sheets

COIN VALIDATING APPARATUS AND METHOD

BACKGROUND OF THE INVENTION

This invention relates in general to an apparatus and technique of validating coins used in coin operated machines.

Coin operated machines have many different techniques for validating the coins employed and for detecting slugs and non-valid coins. These techniques have been around for as long as there have been coin operated machines.

Two coin validating techniques that are relevant to this invention are those shown in the U.S. Pat. Nos. 3,870,137 issued Mar. 11, 1975 and 3,918,565 issued Nov. 11, 1975. These two related patents deal with techniques for identifying a moving coin with an electronic sensor which senses passage of a coin and responds with a signal whose frequency and amplitude provides information about the coin or slug. This information can then be compared with information stored in memory to determine whether or not the coin is a valid coin. One of the techniques employed in these patents is the use of two separate sensors, one operating at a higher frequency and one at a lower frequency, to respond to the coin as it passes through two sensors. The higher frequency interacts more or less with the skin or the outer portion of the coin and the lower frequency interacts with the entire coin.

Another coin sensing device which has been known in this art is described in U.S. Pat. No. 4,416,364 issued Nov. 22, 1983. It shows the use of a sensing coil in association with an oscillator circuit whose output parameters change as a function of the coin in position.

One of the major disadvantages of the technique for detecting a coin as it moves along is that the rate at which the coin moves through the sensor will limit the amount of information and the time span during which sensed information can be obtained. This limits the level of discrimination or sensitivity. Furthermore, there is the possibility of the coin bouncing through in such a fashion as to provide an inadequate and inaccurate sensor response.

In addition, there are certain types of installations, such as coin operated clothes washing and drying machines, which do not have the height necessary to permit the coin to roll under the influence of gravity for the required distance to effect the sensing results obtained by the known techniques.

Most importantly, in all these systems, there is a trade-off between sensitivity and time. More specifically, a trade-off has to be made between false positives and false negatives. Any reasonable system will at times accept an invalid coin (false positive) and at times will reject a valid coin (false negative). In any arrangement, a trade-off has to be made between keeping false positives low and false negatives low.

One of the major objects of this invention is to provide an arrangement which can provide both a lower false positive and a lower false negative result.

A related object of this invention is to achieve this improved validation trade-off with a system that will operate to identify and validate the coin in a time span that is acceptable to the user.

A further object of this invention is to provide such a system as can be adapted for use in a wide variety of coin operated machines particularly machines such as washing and drying machines which do not provide a substantial distance for coins to drop.

A further purpose of this invention is to provide a system which will permit adaptation and adjustment so that factors of sensitivity and discrimination with respect to a particular coin can be enhanced thereby decreasing the risk of a false acceptance (false positive) with respect to slugs or substitutes for the valid coin.

Definitions

The term "coin" is used herein to generally refer to any valid coin, token, invalid coin, counterfeit coin or slug. The more specific term will be used when a less general reference is meant.

Rest frequency and rest amplitude refer to the parameters of the oscillator signal when the oscillator is not coupled to a coin. The rest state of the oscillator is also called the normal state.

The term "set" as used herein includes the situation where there is only one member.

"Recognition Parameter" is used herein to refer to any one or more direct or indirect parameters of the output signal of an oscillator. The parameter may be signal frequency, signal amplitude, difference between measured signal frequency and a standard value frequency, difference between a measured signal amplitude and a standard signal amplitude or any other direct or processed signal value. The recognition parameter used in the embodiment described herein is a point in a processed amplitude vs. frequency plane.

BRIEF DESCRIPTION

In brief, one embodiment of this invention holds the coin close to the coin slot where it is inserted. The coin is electromagnetically coupled to the coils of an oscillator tuned to a first frequency (about 330 KHZ). In this position, the coin is interrogated by the oscillator circuit a number of times; three times in one embodiment.

The output signal from the oscillator is read as to amplitude and frequency. Thus three amplitude readings and three frequency readings are taken. The lowest amplitude value and the highest frequency value is selected. The selected frequency value is provided in hexadecimal form. The last two digits are used as the frequency parameter. The selected amplitude value is subtracted from a stored rest state amplitude value to provide an amplitude deviation parameter. These two parameters become the recognition parameter for the coin involved.

This recognition parameter (that is, the amplitude deviation and the last two digits of the frequency) are compared against stored valid coin range recognition parameters of the two values to determine if there is a match. In particular, a comparison is made against a two-dimensional window in which a first dimension is defined by a range of frequency values (specifically the last two digits of the frequency in hexadecimal form) and a second dimension is defined by a range of amplitude deviation values.

Thus a frequency/amplitude deviation test point is created which is compared against the window. If the test point fits within the window, a match is deemed to have been made and a validating signal indicates that the coin is tentatively valid and ready for the next test.

If a match is made, the rest state of the oscillator is changed from a relatively high frequency (330 KHZ in one embodiment) to a lower frequency (about 89 KHZ in one embodiment) and the multiple sample routine is repeated.

However, if the comparator indicates that the coin is outside the window at the high frequency test, then the three sample interrogations at the first high frequency state is repeated up to five times in one embodiment. If a match of the test point to the window is made during any one of those five cycles (there being three samples during each cycle) then a match is deemed made and the second lower frequency check is made. If no match is obtained during any one of those five cycles, then the coin is deemed to be invalid and sampling stops. The coin can then be removed by the user.

However, if the coin is deemed to have passed the high frequency test, a similar test cycle is undertaken at the second lower frequency state of the oscillator with three samples taken over a single cycle. If the test point for the coin matches against an appropriate window in memory, it is deemed valid.

If a match is not made, then a fairly complex routine ensues. Normally, for a valid coin five cycles will not be used during the high frequency test. If the coin fails to match at the lower frequency, the high frequency test is repeated to revalidate the high frequency match. Assuming that it is revalidated, the lower frequency test is repeated. However, if for any reason, five high frequency test cycles have been completed without a match at both a high frequency test and a successive low frequency test, then the coin is deemed invalid.

THE DRAWINGS

FIG. 1 is a block diagram of the main functional electronic elements and main functional steps of the invention. FIG. 1 illustrates that an Oscillator in a first frequency condition provides a first screen for determining whether or not an input coin is valid. The oscillator in the second frequency condition provides a further screen to determine whether or not an input coin is valid. Coin validity has to be ascertained in each condition for the coin to be accepted.

FIG. 2 is a flow chart representing the logic and the measurement comparison routine to establish coin validity or invalidity.

FIG. 3 is a chart showing two typical acceptance windows of a single valid coin. Window 50 is the acceptance window at a first frequency test of approximately 330 KHZ. Window 52 is the acceptance window at the second frequency test of approximately 89 KHZ.

FIG. 4 is a side view of a coin chute employed with this invention showing the gate 62 on the outside of the front of the chute 60. The solenoid 66 shown in FIG. 5 is omitted from FIG. 4 in order to provide a clearer presentation.

FIG. 5 shows the gate in the coin blocking state.

DESCRIPTION OF THE PREFERRED EMBODIMENTS

FIG. 1—The System

Figure 1:
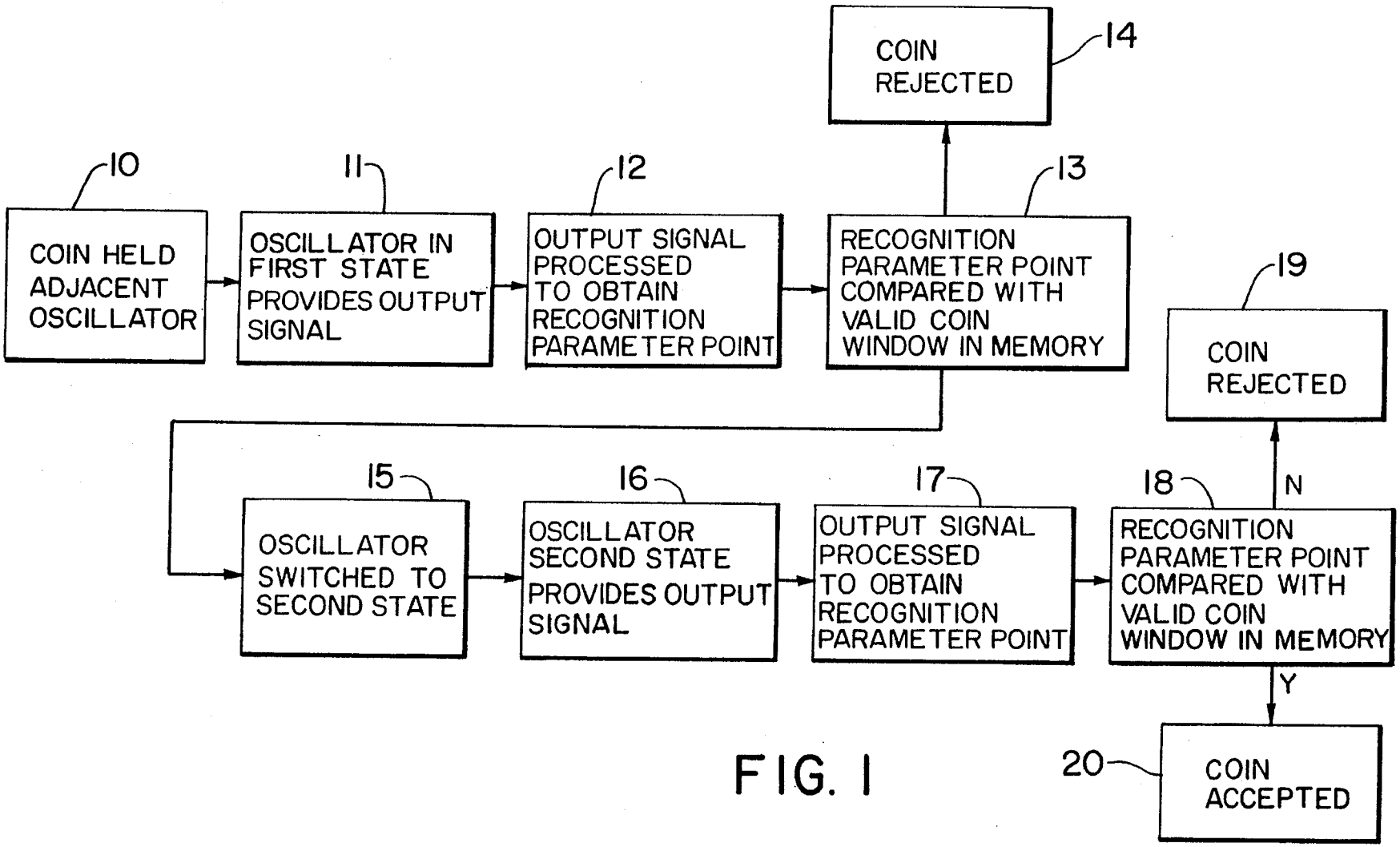

A coin is inserted and held at a predetermined position. The coin is electro-magnetically coupled to the oscillator as indicated at function box 10. The oscillator 11 is in its first frequency rest state (e.g. about 330 KHZ). In that state it provides an output signal which is affected by the presence of the coin being electromagnetically coupled to the oscillator. This output signal has an amplitude and frequency which are read by a processor 12 to provide a first test point for the coin. A comparator 13 compares this first test point with certain expected ranges. An acceptance window held in memory for the coin involved provides the expected ranges.

For each valid coin, there is a two dimensional window in memory. Each window has a frequency range as one dimension and an amplitude range as another dimension. As indicated below, these two ranges are a special range based on frequency and amplitude. If the test point based on the output signal does not fit within one of the windows stored in memory, then as indicated at function box 14 the coin is rejected. However, if the appropriately processed coin test point does fit within one of the windows, then as indicated at function box 15, the oscillator is switched to its second state (e.g. about 89 KHZ).

In the second state, as indicated at function box 16, the oscillator provides a second output signal. As indicated at function box 17, the processor reads the amplitude and frequency of the output signal and provides a second test point for the coin. The comparator compares the second test point with the second amplitude deviation/ frequency window in memory, as indicated at function box 18. Again if no match is made, then as indicated at function box 19 the coin is rejected. If a match is made, then as indicated at function box 20, the coin is accepted.

FIG. 2—The Method

Figure 2:
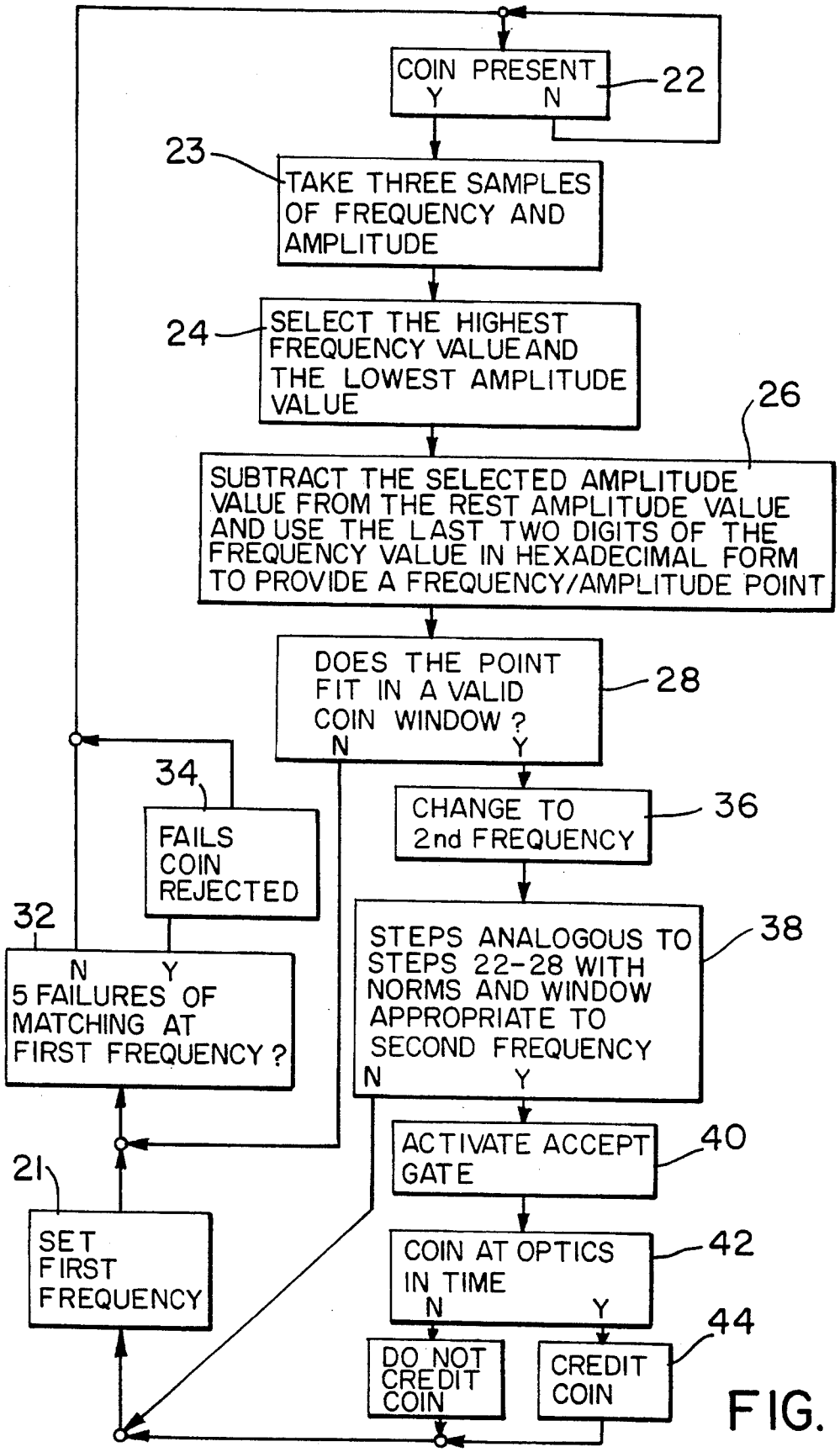

As shown in greater detail in FIG. 2, when no coin is present, the oscillator is tuned to the first rest frequency (step 21). The oscillator thus provides a signal that has a characteristic rest frequency and rest amplitude when there is no coin. When a metallic coin is placed in position, the electrical properties of the coin (or token) cause a frequency increase and amplitude decrease in the output signal from the oscillator.

The coin or token is placed between two halves of the coil which is part of the tuned circuit of the oscillator.

The presence of a coin is sensed at step 22. The next step 23 is to read multiple samples (three in one embodiment) of the frequency and amplitude values with the coin present.

Measured Value Processing

As indicated at step 24, these frequency and amplitude values are processed by a processor in accordance with a particular algorithm. In one algorithm, the greatest of the three frequency values is selected and the least of the three amplitude values is selected. The reason for this is to compensate for coin positioning errors. For example, if the coin does not fully cover the sensor, the deviation from rest state would not be as great as it should be. Accordingly, taking values that will provide the greatest deviation from the rest state in step 24 enhances the likelihood of processing a situation where the coin fully covers this sensor. The oscillator coil is preferably designed so that its diameter is smaller than that of the coins that it is supposed to detect. For example, in FIG. 4, the coin C is larger than the diameter of the coil 64. This provides greater assurance of coverage. However, the technique of using the highest frequency value and lowest amplitude value minimizes coin positioning or coil coverage error.

A second algorithm that might be used is to average the three frequency values and average the three amplitude values. This averaging technique tends to minimize the effect of jitter and noise respectively.

It might be noted that environment and circumstances, most importantly the nature of the coin that has to be identified, may mean that the number of samples can be one or should be more than three.

Obtaining The Point

Figure 3:
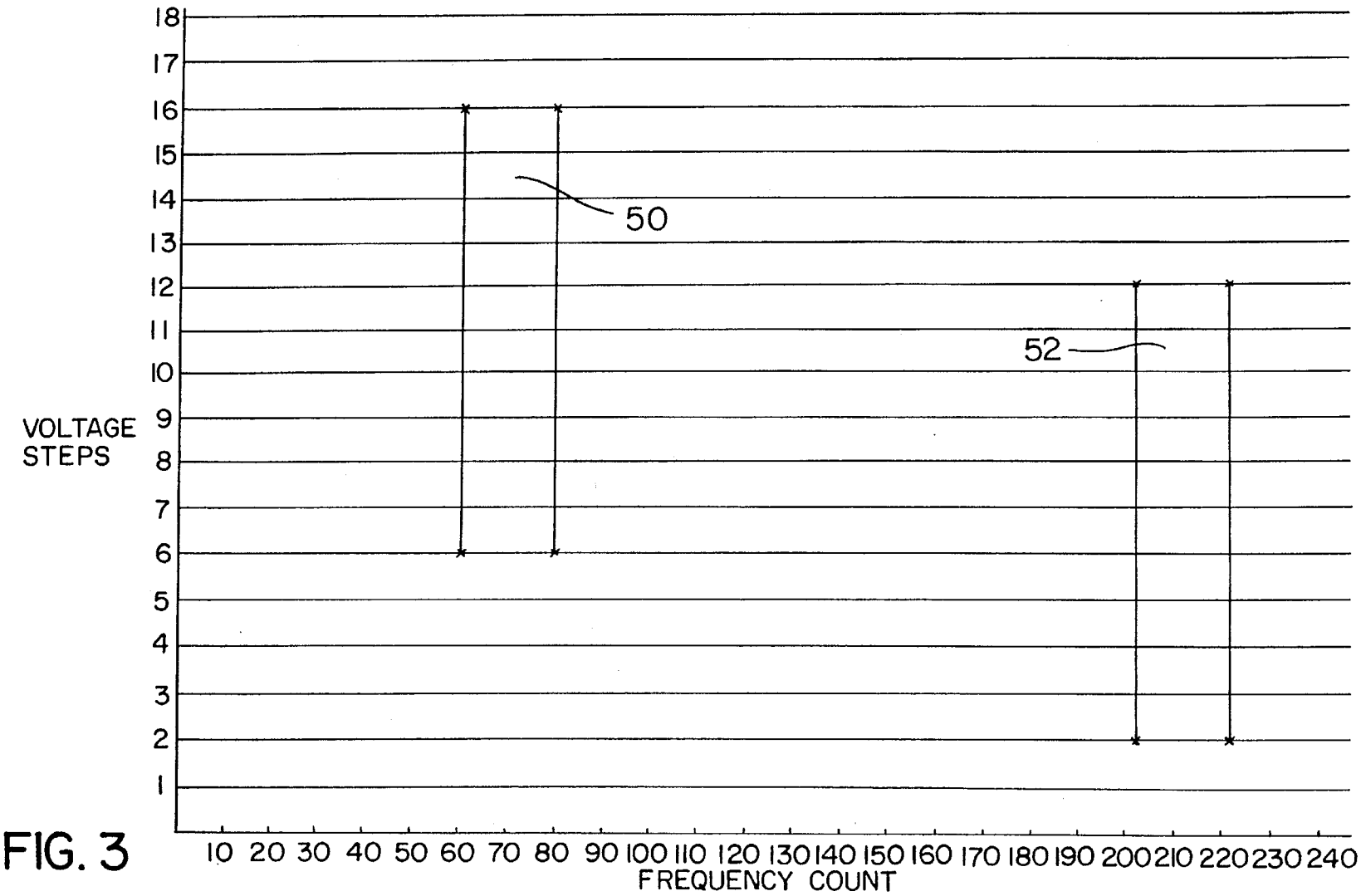

The values provided at step 24 are a frequency value and an amplitude value. As indicated at step 26, the amplitude value is subtracted from the rest amplitude value to provide an amplitude deviation value. The last two digits of the frequency value in hexadecimal form are used to provide the frequency axis value of a test point for the coin. The amplitude axis value of the point is the amplitude deviation value. This frequency/amplitude deviation test point is then compared, by a comparator, as indicated at step 28, to stored acceptable ranges. The stored acceptable ranges can be considered to provide a two dimensional acceptance window. FIG. 3 illustrates one such window 50. If the two values provided at step 26 define a point that fits within that window, there is a match and the process proceeds to a test at the second frequency condition.

However, if the test point from step 26 does not fit within the window, then the steps 22, 23 and 24 are repeated. As indicated at step 32, this cycling is repeated up to five times.

If after five cycles (step 32) no match is made at the first frequency, the coin is deemed to have failed and is rejected (step 34).

If at any one of these five times, the amplitude deviation/frequency test point fits within the acceptance window 50, then as indicated at step 36, the base frequency of the oscillator is changed to the second frequency; which in the embodiment involved is the lower frequency of about 89 KHZ.

At the second frequency, the sequence of steps 22, 23 24, 26 and 28 are undertaken, though the valid coin norms and windows are appropriate for the second frequency. If the frequency/amplitude deviation point is within the appropriate window that is in memory for the second frequency test situation, then as indicated at step 40, the accept gate is activated.

If step 38 does not provide a point which is within the appropriate window in memory for the second frequency state, then as indicated at step 21 the first frequency is reset. If there are any of the five first frequency test cycles remaining, as established by the counter associated with step 32, the process is repeated. The testing at the second frequency does not involve the multiple cycles associated with the testing at the first frequency. After a match is made at the first frequency (step 28), only a single cycle is undertaken at step 38.

Thus there must be a sequence of a valid coin finding at step 28 succeeded by a valid coin finding at step 38 in order to activate the accept gate 40. However, the process can be repeated at the first frequency only five times as determined by the repeat counter at step 32.

The initial windows are established by testing a number of valid coins of the type involved. The size of the windows are set to provide a high degree of acceptance of valid coins and a reasonable degree of discrimination against an improper coin or slug. Once the size of the windows has been established, that size, both height and width, is set in hard memory (ROM).

However, the center of the window is set in E-PROM (variable memory). It is initially set with an appropriate valid coin. That center is then shifted in accordance with the Adjustment procedure disclosed herein. By adjusting the center of the window over a period of time, compensation is made for any slow change in the average value of the coin involved. The Adjustment procedure also compensates for slow drift in the equipment operation due to ageing, temperature changes and other environmental conditions.

It should also be noted that the measured frequency value at step 23 is modified to take into account equipment drift. This modification is described under the Rest State Calibration and Compensation procedure described below.

Coin Acceptance

When the accept gate is activated at step 40, the coin will then fall or roll down through the chute to the area where the coins are collected.

In order to make sure that the person who inserts the coin does not withdraw it just at the time the accept gate is activated, a further step 42 is involved in which the coin must be optically sensed at a downstream point within a predetermined time after the accept gate is activated. The coin is then appropriately logged or credited as indicated at step 44 preferably by a known electronic process so that the value of coins received can be electronically read.

Depending on the flexibility required of a particular design in terms of the number of different coins involved and the need to have a system readily adjusted to accept different types of coins or tokens, various changes can be made in the processing. For example, the number of samples at step 23 could be adjusted as a function of a particular situation. The manner of processing those samples; for example, whether they are averaged or whether the greatest or least values are taken will be a function of experience with particular environments and requirements. The number of cycles or tries at step 32 can be selected to provide either greater minimization of false positives or greater minimization of false negatives.

Rest State Calibration and Compensation

Rest state calibration primarily compensates for circuit value frequency drift. During the time when a coin is not inserted, a calibration stage is undertaken. This calibration step is undertaken at predetermined times. The rest state frequency and amplitude of the oscillator signal is taken at both the first and second frequencies. These rest state values are stored in RAM. To compensate for frequency drift, the updated rest state frequency value stored in RAM is compared against the rest state frequency value stored in E-PROM. This comparison results in a calculation of the shift of the frequency value from the rest state frequency value when the equipment is initially set up. It should be noted that when the machine is being set up, a number of things are established in-memory (ROM and E-PROM). One of the items is rest state frequency and amplitude. The frequency shift value is then applied to modify the measured frequency value selected at step 24 when a coin is present.

Rest state calibration is undertaken only where the rest frequency determined during calibration is within a particular range. This is to avoid responding to a situation when a coin is partially inserted. In such a case, the rest frequency deviation would be very great and would improperly suggest parameter drift. Thus the prior calibration is modified by a new calibration only if the rest value deviation is below a predetermined threshold.

Calibration preferably also occurs each time the machine is powered on. Calibration also preferably occurs right after the equipment is electronically interrogated to obtain the data stored in the equipment.

Miscellaneous

Because of jitter and noise, it may be desirable at step 22 to take three samples of the measurement of frequency and amplitude when a coin is present and take the average of those three samples as the value to be checked against the value stored in memory. One of the advantages of a stationary coin detection system, as contrasted with a moving coin detection system, is that it provides time to take steps to increase the accuracy of the measurement using equipment components having reasonable cost. There is a trade-off between cost and the time available to make a decision. The more time available, the more measurements and samples can be taken thereby decreasing both false-positive errors and false-negative errors.

It might be noted that in the five volt logic system, it is important that the rest frequency of the oscillator be somewhere between 4.75 volts and 5.0 volts in order to get maximum sensitivity without running outside of the amplitude available. The insertion of the coin will cause the measured amplitude to drop so that the rest value can be fairly close to the maximum voltage available in the system.

One advantage of the approach of this invention is that it can respond to slugs made from ferro-magnetic material and also can be used to accept ferro-magnetic valid currency. Most slugs are ferro-magnetic. Accordingly, a magnet is often used to detect an invalid coin. However, there are slugs which are not detected by a magnet. Furthermore, some currency, such as Canadian currency, is ferro-magnetic. Thus there is utility in having a system which can be adjusted to respond to valid coins whether they are ferro-magnetic or not and can reject invalid coins whether they are ferro-magnetic or not.

Specific Example

In one embodiment of this invention which has been constructed and tested, the following operative parameters are used. For the purpose of this example, the United States quarter is one coin that the system is designed to identify.

When the system is tuned to the higher frequency, the signal provided in the rest state (that is when no coin is present) is at 333.48 KHZ and has an amplitude of 4.465 volts.

At the lower frequency condition, the signal at the rest state is at 88.98 KHZ and has an amplitude of 4.484 volts.

A number of United States quarters are used to establish the size of a first acceptance window 50 at the higher frequency condition and a second acceptance window 52 at the lower frequency condition (see FIG. 3). The acceptance window is a two dimensional space of amplitude vs. frequency. More specifically, one of the two dimensions is a range of amplitude differentials and the other dimension is a range of actual frequency values. That is, in this embodiment instead of frequency differential values, the actual frequency is processed to provide one of the two dimensions.

Based on the testing of a number of quarters, these windows are established. For convenience, the frequency measurements are based on a count of the number of cycles or pulses of the signal during a predetermined time period.

At the high frequency, the predetermined time period provides a count of 3,572 cycles in the rest state. When a coin is inserted, the frequency increases and a count is taken over the same time period. A typical coin might provide a count of 3,649 during that time period. The way the equipment operates is that 3,649 is read in hexadecimal form and the last two digits only are employed. The set of test quarters provide one dimension for the frequency window. That dimension is in cycle counts, counting only the last two hexadecimal digits.

As shown in FIG. 3, the acceptance window 50 has a frequency width between 61 counts to 81 counts. The width of the window 50 (that is, the range of 61 to 81 counts) is established based on experience with a large number of United States quarters.

The other window dimension is voltage. For convenience, a set of voltage steps are employed. That is, voltage is measured in steps of 0.019 volts.

In a typical example, a valid quarter could have a voltage of 4.256 volts. That would compare with the rest voltage of 4.465 volts. The difference of 0.209 volts constitutes eleven steps (that is, 0.209 divided by 0.019). Again based on experience, the acceptance window 50 is set to a height representing a dip of between six and sixteen steps from the rest voltage.

The above means that an acceptable quarter can cause the amplitude to dip to anywhere between 4.351 volts and 4.161 volts and can cause the frequency to increase anywhere between 340,297 HZ and 342,164 HZ. A coin which provides a result that falls outside of that window, because either one or both parameters is outside of the window, will be deemed to be a coin that at that point failed to be acceptable. Of course, as explained above, these tests are repeated a number of times and if the coin falls within the window during any one of the five tests, it is passed to the next step of the testing.

The same procedure is followed at the lower frequency of 88,980 HZ. The same time frame for counting the number of cycles or pulses is employed at the rest frequency. The 88,980 HZ lower rest frequency provides a count of 957. Using the last two hexadecimal digits, the frequency count acceptance window 52 has a width between 206 and 226 counts. That window 52 has an acceptance differential voltage amplitude of between two and twelve steps.

This lower rest frequency based window 52 represents a voltage range of between 4.246 and 4.256 volts and a frequency range of between 114,365 HZ and 116,225 HZ.

The above is only one example of the application of this invention to acceptance of the United States quarter. The ranges will vary appreciably depending upon the coin that is to be accepted. Furthermore, as also pointed out above, the positions but not the size of windows will shift with time to compensate for equipment drift.

As indicated, experience with a number of United States quarters indicates an acceptance window at each rest frequency that is twenty counts wide and ten steps high. The variability in a Canadian quarter calls for a window of forty counts by twenty steps.

The above discussion of the size of the window does not fully indicate where that window is positioned. In one procedure that has been followed, a close to ideal coin is used in manufacturing to establish the center of the window. In that embodiment, the center of the window is set in variable memory (E-PROM). By contrast, the size of the window (for example, 20 counts by 10 steps) is set in hard memory because the size is based on the testing of a large number of the coins involved. The reason the center of the window is in variable memory is because of the Adjustment Procedure.

Adjustment

The center of the windows 50, 52 for a particular coin is stored in E-PROM. In order to adapt to systemic changes in the valid coins, a procedure is followed in which each time a valid coin is put through, track is kept of the deviation of that valid coin from the center of the relevant windows 50, 52. A continuing score is kept of the algebraic deviation frequency count and the voltage steps from the center of the windows.

With reference to the specific example disclosed herein, an individual valid coin might show a deviation from the center of a window of two or three counts in the frequency measurement. When the algebraic sum of these deviations from successive accepted coins exceeds a predetermined number, an adjustment in the center of the window is made. In the case of one embodiment, that predetermined number is plus or minus 16 (which is useful because of the hexadecimal system employed). When the predetermined count is reached, a one count adjustment is made in the appropriate direction to the acceptance window center point stored in E-PROM. The procedure then starts all over. In this fashion, there is a long range slow adaptation to the parameters of the valid coin. Of course, this also provides a long range slow adjustment to a circuit characteristic drift. However it is preferred to have the calibration procedure described above in addition to this adjustment procedure because, for example, a machine or system might be unused for a long period of time.

The Coin Chute

Figure 4:
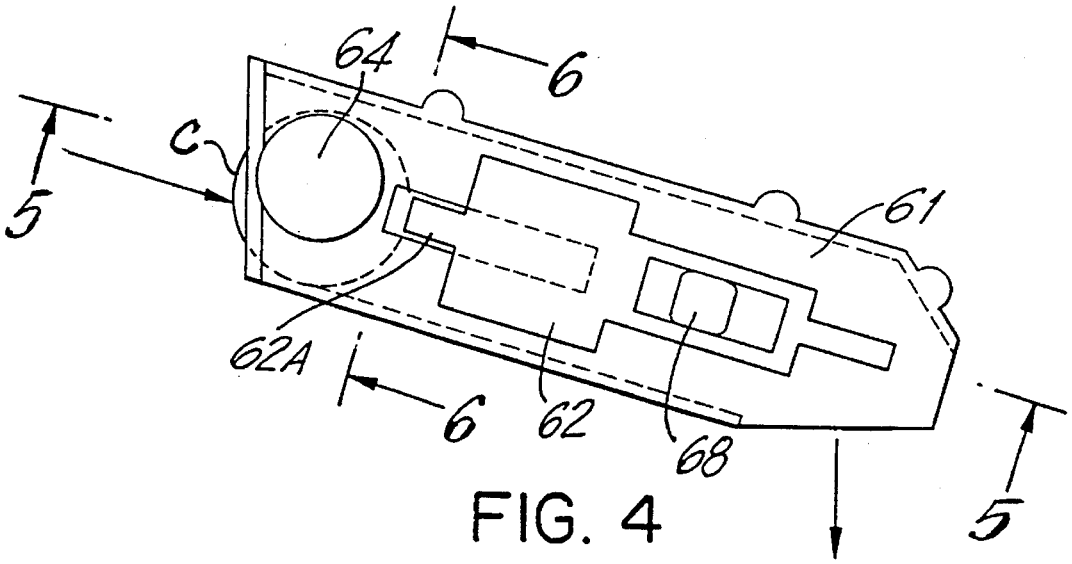
Figure 5:
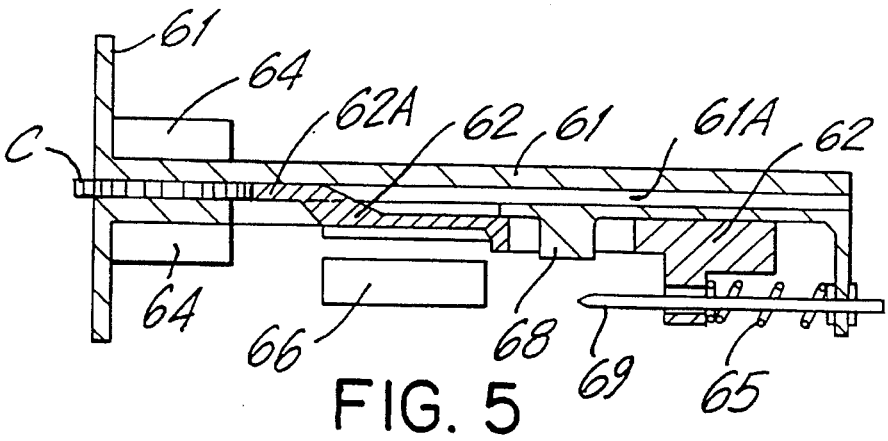
FIG. 5 is a cross-section along the plane 5—5 of FIG. 4 and illustrates the leg 62A of the gate extending into the track 61A. Accordingly.
Figure 6:
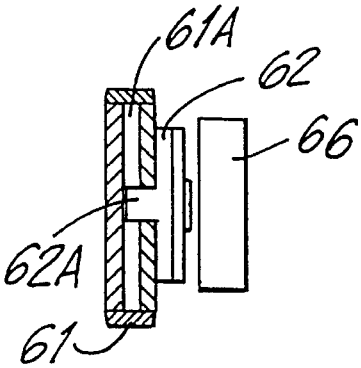
FIG. 6 is a cross-section along the plane 6—6 of FIG. 4 and shows the leg 62A of the gate extending into the coin track 61A.

FIGS. 4, 5 and 6 illustrate a coin chute 61 having a gate 62 mounted outside of the chute with a leg 62A of the gate extending into the coin track 61A within the chute 61. The coin track 61A is defined by the two sidewalls of the chute. The track is sized to accept the range of coins which the vending machine is designed to receive. A coin C is shown in position in the track 61A. The coin C is between the two sensor coils 64. The sensor coils 64 are the coils of the oscillator referred to in function box 11. The gate 62 contacts the leading edge of the coin at the position where the coin is between the two sensor coils 64.

The gate 62 is spring loaded by spring 65 so that an edge of the coin C normally protrudes out of the coin chute 61. Thus an invalid coin or slug can be readily removed and will not clog the apparatus.

The gate 62 is spring biased into the outboard position by a spring 65. When a coin is introduced, it moves the gate 62 inward against the spring 65 and, in a normal situation, the time of coin residence between the sensor coils 64 is sufficient so that a determination is made as to whether or not the coin is valid before the coin has been inserted all the way into the chute 61. If the coin is deemed valid, the solenoid 66 moves the gate 62 laterally out of the way so that the coin can continue down the track 61A and be collected at an exit zone.

The optics for locating the coin after an appropriate time, as indicated in step 42 of FIG. 2A, is a known technique. Thus the optics is not shown in FIGS. 4–6 in order to simplify presentation.

The gate 62, solenoid 66 and spring 65 are all mounted outside the coin chute 61. A leg 62A of the gate 62 extends through a slot on the side of the coin chute, into the coin track 61A.

A guide 68 together with the support provided by the pin 69 and spring 65 serves to appropriately position the gate 62 in both the state shown where the solenoid 65 is not energized as well as in the state where the solenoid is energized.

The use of the spring 65 loaded gate 62 to prevent acceptance of the coin until it has been deemed a valid coin assures that the dwell time of the coin between the oscillator coils 64 will be sufficient to permit the electronics to go through the cycle necessary to come to a decision as to whether or not the coin is valid or invalid. The gate 62 is not moved out of the way until after a valid determination has been made. The spring loading of the gate 62 maintains the coin in a position where it is between the two sensor coils.

In many situations, the acceptance of the coin will be sufficiently rapid so there will appear to be, or may actually be, a continuous movement between the pushing of the coin into the slot against the spring loaded gate 62 and the movement of the gate out of the way to accept the coin. The user will normally sense the valid coin as not stationary. In certain cases, the coin may not actually be stationary. But, the important point is that the coin does not move under the effect of gravity until the gate 62 has been moved out of the way upon the determination that the coin is valid. This assures the dwell time necessary to permit whatever multiple tests and multiple cycles are useful to achieve the objectives of low false positives and low false negatives.

Variations On The Embodiment Disclosed

The machine can be designed to accommodate a number of coins; seven in one embodiment. In the first frequency measurement (which is the higher frequency measurement in these embodiments) the acceptance windows for each of these coins should not overlap. Although one can adjust the algorithm if there is some overlap, it becomes unnecessarily complex. It is preferable to obtain windows that do not overlap. It should be noted that windows need not be rectangular and can be contoured by having corners cut off. That might be useful to minimize the possibility of overlap. In that fashion at the higher frequency test, a coin if accepted will be unambiguously identified.

At the lower frequency test normally only the associated window will be put into effect. Thus if there is some overlap of windows for different coins at the lower frequency, that would not create a problem. Normally, only one window is to be employed at the lower frequency test.

Because the coin is stationary in the sense that it does not roll until the gate 62 is removed, the number of samples during each test cycle can be adjusted based on experience in a particular situation and the number of test cycles that can be run through before a coin is rejected can be adjusted. Thus, because the coin is stationary adequate time can be provided, subject only to the customer's desires for a prompt response, to take whatever multiple steps are optimum in order to meet the objective of having a low rejection rate for valid coins and a low acceptance rate for invalid coins. The time available for assessing the coin also makes it both easier and more feasible to adapt a system for acceptance of a number of different valid coins of different denominations.

As indicated in a number of places in the disclosure, a number of variations in the particular techniques and algorithms used can be employed within the scope of this invention. For example, a comparison of the specific example given with the more generic description will show that the recognition parameter and thus the acceptance window can be based either on (a) the difference between signal parameter values when valid test coins are employed and the values when the oscillator is in the rest state or (b) the values of the signal parameters when valid test coins are used. In the latter case, practical design considerations call for using less than the entire count or value and, as indicated by a specific example, where the actual value of the frequency is the basis for the signal parameter, only the last two hexadecimal places of that value is used.

When the recognition parameter is based on two signal parameter values, the recognition parameter of a particular coin be considered a point in a two dimensional window.

What is claimed is:

1. A coin validating system comprising:

an oscillator having at least first and second output frequency states, said states having first and second output signals, respectively, a coin gate to hold a coin in a position to electromagnetically couple the coin to said oscillator and thus provide a change in characteristics of said output signals, a processor coupled to said output signals to obtain at least first and second recognition parameter values from said first and second outputs signals, respectively, a memory to hold first and second standard valid coin recognition parameter ranges, said first and second standard recognition parameter ranges corresponding to recognition parameter values obtained from a set of a particular issue of valid coins coupled to said oscillator in said first and second state respectively, comparison means to compare said first recognition parameter value for a coin in position at said gate with said first standard recognition parameter range when said oscillator is in said first state, to provide a first validating signal in response to the value of said first recognition parameter value being within said first standard recognition parameter range, switching means responsive to said first validating signal to switch said oscillator from said first state to said second state, said comparison means comparing said second recognition parameter value for the coin in position at said gate with said second standard recognition parameter range, when said oscillator is in said second state, to provide a second validating signal in response to the value of said second recognition parameter value being within said second standard recognition parameter range, said coin gate accepting the coin held by said gate in response to said second validating signal, and said gate rejecting the coin held by said gate unless said second validating signal is generated.

2. The coin validating system of claim 1 wherein:

at least a part of at least the first or second recognition parameter is a function of the amplitude of said output signal.

3. The coin validating system of claim 1 wherein:

said comparison means provides an indication when said first recognition parameter value is outside of said first standard recognition parameter range, and a repeat means responds to said indication from said comparison means to cause said processor to obtain said first recognition parameter value, when said oscillator is in said first state, an additional time and wherein, said repeat means is responsive only a predetermined number of times to said indication from said comparison means.

4. The coin validating system of claim 1 wherein:

said processor samples each of said first and second output signals a predetermined number of times and wherein said processor further selects said first and second recognition parameter values on a predetermined basis from said predetermined number of samples.

5. The coin validating system of claim 4 wherein:

said comparison means provides an indication when said first recognition parameter value is outside of any of said first standard recognition parameter range, and a repeat means responds to said indication from said comparison means to cause said processor to obtain said first recognition parameter value, when said oscillator is in said first state, an additional time and wherein, said repeat means is responsive only a predetermined number of times to said indication from said comparison means.

6. The coin validating system of claim 1 wherein:

at least a part of at least the first or second recognition parameter is a function of the frequency of said output signal.

7. The coin validating system of claim 6 wherein:

said comparison means provides an indication when said first recognition parameter value is outside of any of said first standard recognition parameter range, and a repeat means responds to said indication from said comparison means to cause said processor to obtain said first recognition parameter, value when said oscillator is in said first state, an additional time and wherein, said repeat means is responsive only a predetermined number of times to said indication from said comparison means.

8. The coin validating system of claim 6 wherein:

said processor samples each of said first and second output signals a predetermined number of times and wherein said processor further selects said first and second recognition parameter values on a predetermined basis from said predetermined number of samples.

9. The coin validating system of claim 8 wherein:

said comparison means provides an indication when said first recognition parameter value is outside of said first standard recognition parameter range, and a repeat means responds to said indication from said comparison means to cause said processor to obtain said first recognition parameter value, when said oscillator is in said first state, an additional time and wherein, said repeat means is responsive only a predetermined number of times to said indication from said comparison means.

10. The coin validating system of claim 1 wherein:

said first and second recognition parameters are a function of the frequency and the amplitude of said output signal.

11. The coin validating system of claim 10 wherein:

said comparison means provides an indication when said first recognition parameter value is outside of said first standard recognition parameter range, and a repeat means responds to said indication from said comparison means to cause said processor to obtain said first recognition parameter value, when said oscillator is in said first state an additional time and wherein, said repeat means is responsive only a predetermined number of times to said indication from said comparison means.

12. The coin validating system of claim 10 wherein:

said processor samples each of said first and second output signals a predetermined number of times and wherein said processor further selects said first and second recognition parameter values on a predetermined basis from said predetermined number of samples.

13. The coin validating system of claim 12 wherein:

said comparison means provides an indication when said first recognition parameter value is outside of said first standard recognition parameter range, and a repeat means responds to said indication from said comparison means to cause said processor to obtain said first recognition parameter value, when said oscillator is in said first state, an additional time and wherein, said repeat means is responsive only predetermined number of times to said indication from said comparison means.

14. A coin validating system comprising:

an oscillator having at least first and second output frequency states, said states having first and second output signals, respectively, a coin gate to hold a coin in a position to electro-magnetically couple the coin to said oscillator and thus provide a change in characteristics of said output signals, a processor coupled to said output signal to provide first and second recognition test points, each test point based on the amplitude and the frequency of said output signals when said oscillator is in said first and second frequency states respectively, a memory to hold first and second windows based on first and second ranges of normal valid coin first and second test points respectively, comparison means to compare said first test point for a coin in position at said gate with said first window, when said oscillator is in said first frequency state, to provide a first validating signal in response to the value of said first test point being within said first window, switching means responsive to said first validating signal to switch said oscillator from said first state to said second state, said comparison means comparing said second test point for the coin in position at said gate with said second window, when said oscillator is in said second frequency state, to provide a second validating signal in response to the value of said second test point being within said second window, said coin gate accepting the coin held by said gate in response to said second validating signal, and said gate rejecting the coin held by said gate unless said second validating signal is generated.

15. The coin validating system of claim 14 wherein:

said comparison means provides an indication when said first test point is outside said first window, and a repeat means responds to said indication from said comparison means to cause said processor to sample said first output signal and provide said first test point an additional time, and wherein, said repeat means is responsive only a predetermined number of times to said indication from said comparison means.

16. The coin validating system of claim 14 wherein:

said processor samples each of said first and second output signals a predetermined number of times, and said processor includes selection means for selecting from said predetermined number of samples, based on a predetermined criteria, said first and second recognition test points.

17. The coin validating system of claim 16 wherein:

said comparison means provides an indication when said first test point is outside said first window, and a repeat means responds to said indication from said comparison means to cause said processor to sample said first output signal and provide said first test point an additional time and wherein, said repeat means is responsive only a predetermined number of times to said indication from said comparison means.

18. The method of validating a coin comprising the steps of:

holding the coin to be validated in a predetermined position, setting an oscillator to a first predetermined frequency state, electro-magnetically coupling said coin to be validated to said oscillator in said first frequency state, reading a first output signal from said oscillator with said coin so coupled, generating a first recognition parameter value from said first output signal, comparing said first recognition parameter value with a first predetermined range of valid coin recognition parameter values held in memory, generating a first validating signal if said first recognition parameter value fits within said first range, in response to said first validating signal, switching said oscillator from said first frequency state to a second predetermined frequency state, reading a second output signal from said oscillator in said second state, generating a second recognition parameter value from said second output signal, comparing said second recognition parameter value with a second predetermined range of valid coin recognition parameter values held in memory, generating a second validating signal if said second recognition parameter value fits within said second range, accepting the coin in response to said second validating signal, and rejecting said coin in the absence of said second validating signal.

19. The method of validating a coin comprising the steps of:

holding the coin to be validated in a predetermined position, setting an oscillator to a first predetermined frequency state, electro-magnetically coupling said coin to be validated to said oscillator, reading a first output signal from said oscillator with the coin coupled thereto, generating a first recognition test point based on the amplitude and frequency of said first output signal, comparing said first test point to a first window in memory, said first window representing a first range of normal valid coin first test points, generating a first validating signal if said first test point is within said first window, in response to said first validating signal, switching said oscillator from a first predetermined frequency state to a second predetermined frequency state, reading a second output signal from said oscillator in said second state, generating a second recognition test point based on the amplitude and frequency of said second output signal, comparing said second test point to a second window in memory, said second window representing a second range of normal valid coin test points, generating a second validating signal if said second test point is within said second window, accepting the coin coupled to said oscillator in response to said second validating signal, and rejecting said coin unless said second validating signal is generated.

* * * * *